US010944163B2

(12) United States Patent
Coupez

(10) Patent No.: US 10,944,163 B2
(45) Date of Patent: Mar. 9, 2021

(54) BUNG-TYPE ANTENNA AND ANTENNAL STRUCTURE AND ANTENNAL ASSEMBLY ASSOCIATED THEREWITH

(71) Applicant: INSTITUT MINES TELECOM / TELECOM BRETAGNE, Brest (FR)

(72) Inventor: Jean-Philippe Coupez, Brest (FR)

(73) Assignee: INSTITUT MINES TELECOM/TELECOM BRETAGNE, Brest (FR)

( * ) Notice: Subject to any disclaimer, the term of this patent is extended or adjusted under 35 U.S.C. 154(b) by 9 days.

(21) Appl. No.: 14/905,605

(22) PCT Filed: Jul. 15, 2014

(86) PCT No.: PCT/EP2014/065176
§ 371 (c)(1),
(2) Date: Jan. 15, 2016

(87) PCT Pub. No.: WO2015/007746
PCT Pub. Date: Jan. 22, 2015

(65) Prior Publication Data

US 2016/0156095 A1 Jun. 2, 2016

(30) Foreign Application Priority Data

Jul. 15, 2013 (FR) ..... 1356954

(51) Int. Cl.
*H01Q 11/08* (2006.01)
*H01Q 1/38* (2006.01)
(Continued)

(52) U.S. Cl.
CPC ..... *H01Q 1/38* (2013.01); *H01Q 1/362* (2013.01); *H01Q 1/50* (2013.01); *H01Q 1/523* (2013.01); *H01Q 11/08* (2013.01); *H01Q 21/29* (2013.01)

(58) Field of Classification Search
CPC ..... H01Q 1/38; H01Q 1/362; H01Q 1/50; H01Q 1/523; H01Q 11/08; H01Q 21/29
See application file for complete search history.

(56) References Cited

U.S. PATENT DOCUMENTS 3,573,840 A * 4/1971 Gouillou ..... H01Q 1/38 343/895
3,906,509 A * 9/1975 DuHamel ..... H01Q 1/362 343/895

(Continued)

FOREIGN PATENT DOCUMENTS

EP 0588465 A1 * 3/1994 ..... H01Q 9/0407
GB 2292638 A 2/1996
WO 9943044 A1 8/1999

OTHER PUBLICATIONS

International Search Report for PCT/EP2014/065176, dated Sep. 11, 2014.
Written Opinion for PCT/EP2014/065176, dated Sep. 11, 2014.

*Primary Examiner* — Dimary S Lopez Cruz
*Assistant Examiner* — Bamidele A Jegede
(74) *Attorney, Agent, or Firm* — Meagher Emanuel Laks Goldberg & Liao, LLP.

(57) ABSTRACT

The invention relates to an antennal structure adapted to be disposed on an earth plane comprising: a three-dimensional support substrate made of a dielectric material which is partially hollowed out and comprising a peripheral wall which extends between a proximal end and a distal end, said support substrate defining an internal volume; a first conducting pattern inscribed on the peripheral wall of the support substrate, the first conducting pattern comprising a lower end adapted to be connected to an earth plane and an upper end; a second conducting pattern contained in the volume of the substrate, the second pattern being connected electrically to the upper end of the first pattern.

12 Claims, 7 Drawing Sheets

(51) Int. Cl.

| | |
|---|---|
| ***H01Q 1/36*** | (2006.01) |
| ***H01Q 1/50*** | (2006.01) |
| ***H01Q 1/52*** | (2006.01) |
| ***H01Q 21/29*** | (2006.01) |

(56) References Cited

U.S. PATENT DOCUMENTS 4,511,843 A * 4/1985 Thoraval ..... G01V 3/30 324/338
4,608,574 A * 8/1986 Webster ..... H01Q 11/08 343/895
4,612,543 A * 9/1986 DeVries ..... G01S 13/767 342/187
5,099,249 A * 3/1992 Seavey ..... H01Q 1/3275 343/700 MS
5,943,027 A * 8/1999 Thill ..... H01Q 1/10 343/895
5,945,963 A * 8/1999 Leisten ..... H01Q 11/08 343/895
5,963,180 A * 10/1999 Leisten ..... H01Q 5/357 343/895
5,990,848 A * 11/1999 Annamaa ..... H01Q 11/08 343/725
6,069,590 A * 5/2000 Thompson, Jr. ..... H01Q 1/42 343/795
6,075,501 A * 6/2000 Kuramoto ..... H01Q 11/08 343/895
6,172,656 B1 * 1/2001 Ohwada ..... H01Q 1/244 343/700 MS
6,177,911 B1 * 1/2001 Yuda ..... H01Q 1/246 343/790
6,184,845 B1 * 2/2001 Leisten ..... H01Q 1/242 343/821
6,288,682 B1 * 9/2001 Thiel ..... H01Q 1/242 343/702
6,300,917 B1 * 10/2001 Leisten ..... H01Q 1/36 343/702
6,424,316 B1 * 7/2002 Leisten ..... H01Q 1/242 343/895
6,459,413 B1 * 10/2002 Tseng ..... H01Q 1/243 343/700 MS
2002/0140622 A1 * 10/2002 Park ..... H01Q 1/242 343/895
2003/0034932 A1 * 2/2003 Huebner ..... H01Q 1/38 343/795
2005/0146471 A1 * 7/2005 Kwon ..... H01Q 1/38 343/702
2007/0030210 A1 2/2007 Shibata
2008/0062058 A1 * 3/2008 Bishop ..... H01Q 1/52 343/835
2008/0150811 A1 * 6/2008 Honda ..... H01Q 9/40 343/702
2008/0258991 A1 * 10/2008 Montgomery ..... H01Q 1/243 343/844
2013/0050031 A1 * 2/2013 Zhu ..... H01Q 1/523 343/702

* cited by examiner

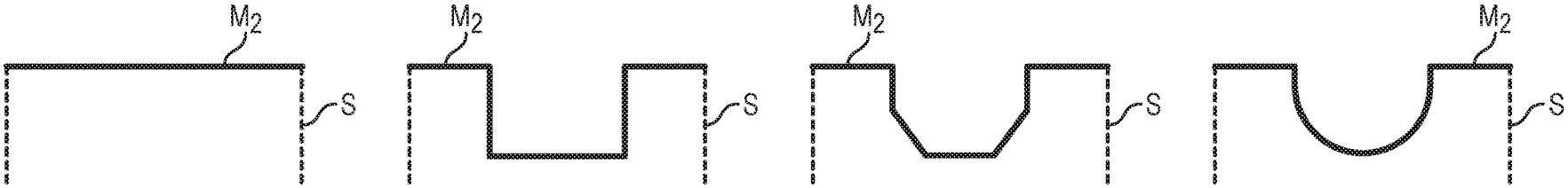
FIG. 4a
FIG. 4b
FIG. 4c
FIG. 4d
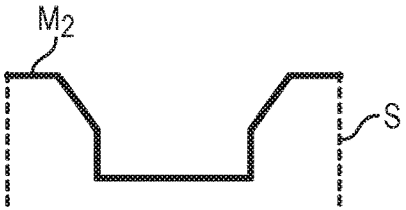
FIG. 4e
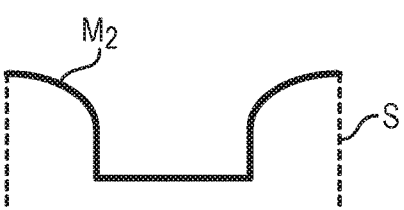
FIG. 4f
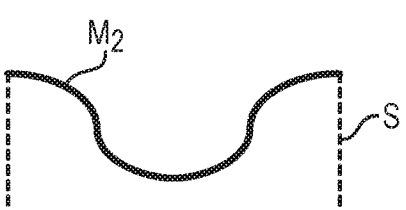
FIG. 4g
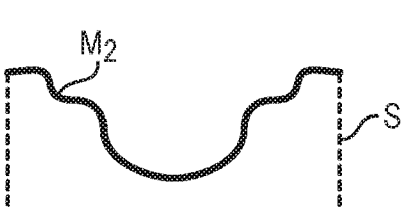
FIG. 4h

BUNG-TYPE ANTENNA AND ANTENNAL STRUCTURE AND ANTENNAL ASSEMBLY ASSOCIATED THEREWITH

GENERAL TECHNICAL FIELD

The invention relates to radiofrequency antennae especially those usable in wireless radio communication systems.

PRIOR ART

An antenna is an essential element of a wireless radio communication device.

The development of wireless radio applications and the development of new telecommunications standards require antennae capable of being integrated into various types of hardware.

Antennae solutions that have particularly high performances in terms of size, volume and weight are therefore being researched especially for antennae solutions intended for applications in the VHF or UHF frequency ranges.

Specifically, in these frequency ranges the wavelengths involved are long, thereby conventionally leading to bulky antennae solutions.

Document GB 2 292 638 discloses an antenna formed from a cylindrical dielectric bar (of high relative dielectric permittivity—higher than 5), said bar being apertured in order to allow a supply structure to be passed therethrough. The antenna comprises a plurality of radiating elements on the exterior surface of the bar, the radiating elements being connected in parallel between the supply and a ground plane.

PRESENTATION OF THE INVENTION

The invention provides a compact antenna solution that is easily producible.

For this purpose, the invention provides, according to a first aspect, an antenna structure suitable for being placed on a ground plane, comprising:

a three-dimensional carrier substrate made of a partially apertured dielectric material comprising a peripheral wall that extends between a proximal end and a distal end, said carrier substrate defining an internal volume;

a first conductive pattern inscribed on the peripheral wall of the carrier substrate, the first conductive pattern having a lower end suitable for being connected to a ground plane and an upper end; and a second conductive pattern contained in the volume of the substrate, the second pattern being electrically connected to the upper end of the first pattern.

The following are other aspects of the antenna structure, which may be applied alone or in combination:

- the carrier substrate is the shape of a cylinder of revolution, a truncated cone, a cube, a right prism having a hexagonal base, a truncated pyramid or a volume with a sinuous profile;
- the first pattern is a conductive wire or a conductive strip;
- the first pattern is inscribed on the peripheral wall so as to be wound into a helix around the carrier substrate;
- the first pattern has a meandering shape, a sinusoidal shape, a shape formed from a combination of rectilinear and sinuous shapes or a shape made up of one or more fractal patterns;
- the second pattern is configured to at least partially obturate the distal end of the carrier substrate;

- the second conductive pattern has a transverse profile chosen from the following group: straight, top-hat, a succession of straight lines, a succession of straight and curved lines, and a succession of curved lines;
- the second conductive pattern comprises: a hollow section having a peripheral wall that extends between a lower end and an upper end, said section extending into the internal volume defined by the carrier substrate; and a flange that extends from the upper end of the section to the distal end of the carrier substrate; and/or
- the second conductive pattern also has a bottom completely closing the lower end of the section.

According to a second aspect, the invention provides an antenna comprising a ground plane and an antenna structure according to the first aspect of the invention and placed above said ground plane, the lower end of the first conductive pattern being connected to the ground plane.

The antenna of the invention furthermore comprises an excitation probe suitable for supplying the antenna structure, the excitation probe being connected, by way of a central conductor of said excitation probe, to the first conductive pattern via a connection point located along the first conductive pattern on the peripheral wall.

According to a third aspect, the invention provides an antenna array comprising: a ground plane; a plurality of identical antenna structures according to the first aspect of the invention; and an excitation probe connected, by way of the central conductor of said excitation probe, to the first conductive pattern of only one antenna structure from the plurality of antenna structures, said antenna structure thus excited defining a primary element of the antenna array, the at least one other antenna structure defining at least one "passive" secondary element that is not supplied directly.

The following are other aspects of the antenna array of the invention, which may be applied alone or in combination:

- the array comprises two antenna structures placed on the ground plane side-by-side and separated by a distance smaller than a fraction of the operating wavelength $\lambda$ of the antenna array, typically smaller than $\lambda/20$;
- the array comprises three antenna structures placed triangularly on the ground plane; and/or
- the array comprises at least one conductive wall suitable for decreasing the coupling between the antenna structures, the conductive wall forming an electrical screen between the antenna structures.

The invention has multiple advantages.

The dimensions of the antenna of the invention are very small relative to the wavelength of the signal (i.e. about $\lambda/50$, or even smaller than this value).

This facilitates use in any application placing very tight constraints on bulk and weight, such as, for example, remote reader applications in the VHF or UHF frequency ranges.

Because the two conductive patterns are closely imbricated in a given volume, the invention makes it possible to obtain an extremely compact antenna or antenna array for a set operating frequency.

Furthermore, with the invention it is very simple to adjust performance. Specifically, operating frequency is very easy to adjust since it is a function of the value of the developed length of the first conductive pattern, and the aspect ratio and dimensions chosen for the second conductive pattern.

Furthermore, the mismatch loss level of the antenna of the invention may also be easily optimized via an appropriate choice of the position of the point of excitation on the first pattern with respect to the lower end of the first pattern, said end itself being connected to ground.

Furthermore, with the invention it is possible to obtain an antenna solution or antenna array that is very easy to produce and at low cost.

PRESENTATION OF THE FIGURES

Other features, aims and advantages of the invention will become apparent from the following description, which is purely illustrative and nonlimiting, and which must be read with regard to the appended drawings, in which:

FIG. 1 illustrates an antenna according to one embodiment of the invention;

FIGS. 2*a*, 2*b*, 2*c*, 2*d*, 2*e*, 2*f* and 2*g* illustrate a plurality of shapes of the carrier substrate of an antenna structure according to the invention;

FIGS. 3*a*, 3*b* and 3*c* illustrate a plurality of shapes of the first conductive pattern of an antenna structure according to the invention;

FIGS. 4*a*, 4*b*, 4*c*, 4*d*, 4*e*, 4*f*, 4*g* and 4*h* illustrate shapes of the transverse profile of the second conductive pattern of an antenna structure according to the invention;

FIGS. 5*a*, 5*b* and 5*c* respectively illustrate a perspective view, a cross-sectional view along B-B' and a side view of an antenna according to one embodiment of the invention;

In all the figures, similar elements have been referenced with identical references.

DETAILED DESCRIPTION OF THE INVENTION

Antenna

Figure 1:
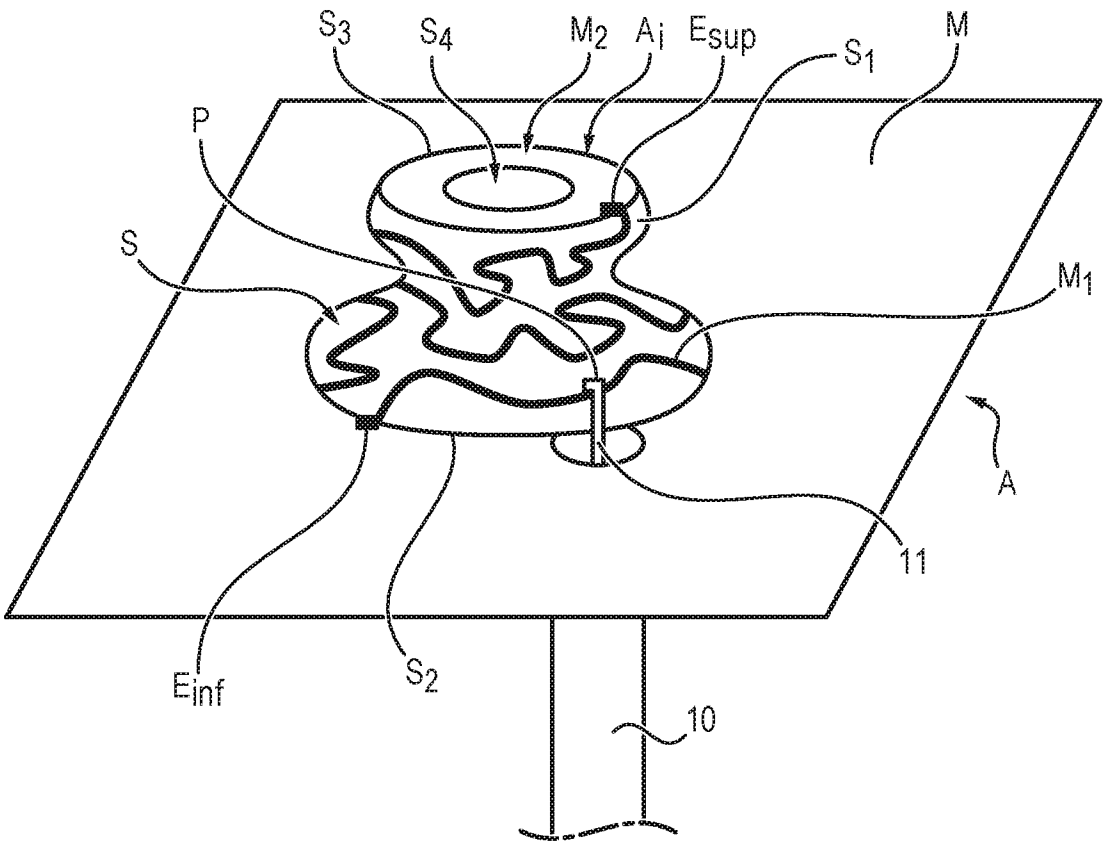

In relation to FIG. 1, an antenna A according to the invention comprises an antenna structure Ai and a ground plane M, the antenna structure is placed above the ground plane M. The antenna structure Ai comprises: a three-dimensional carrier substrate S made of a partially apertured dielectric material, a first conductive pattern M1, and a second conductive pattern M2.

The partially apertured substrate S comprises a peripheral lateral wall S1 that extends between a proximal end S2 and a distal end S3. Furthermore, the carrier substrate S defines an internal volume S4 that may be partially filled with dielectric material. The internal volume S4 is thus encircled by the peripheral wall S1.

The carrier substrate S may be made of a dielectric material such as a plastic or plastic foam, the electrical properties of which are preferably very similar to those of air, or even quite simply of air. In particular, the relative dielectric permittivity of the carrier substrate S is preferably close to 1, i.e. comprised between 1 and 1.5.

The first pattern M1 is inscribed on the peripheral lateral wall S1 of the carrier substrate S and has a lower end Einf suitable for being connected to the ground plane M, and an upper end Esup.

The second conductive pattern M2 is configured to be contained in the volume S4 of the substrate S and is electrically connected to the upper end Esup of the first pattern M1. The second pattern M2 is preferably produced on a three-dimensional surface. It is typically a question of a patch conductor pattern. The three-dimensional surface may be a surface of the substrate S or a surface of a separate element inserted into the volume S4.

The second conductive pattern M2 is furthermore configured to obturate, like a lid, the distal end S3 of the carrier substrate S.

Again in relation to FIG. 1, the antenna comprises a coaxial excitation probe 10 the central conductor 11 of which is connected to a point P of the first conductive pattern M1 on the peripheral wall S1 of the carrier S.

Figure 2A:
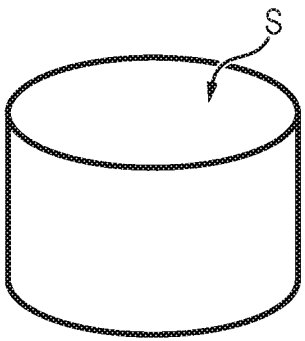
Figure 2B:
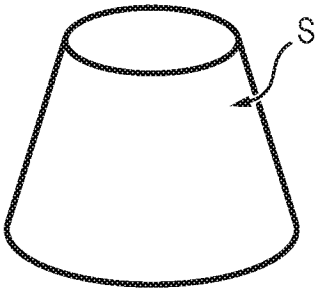
Figure 2C:
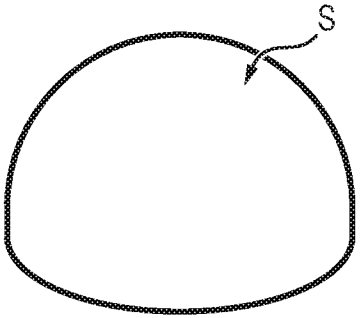
Figure 2D:
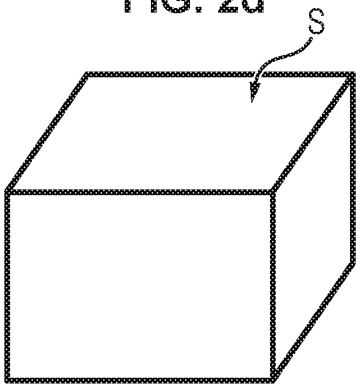
Figure 2E:
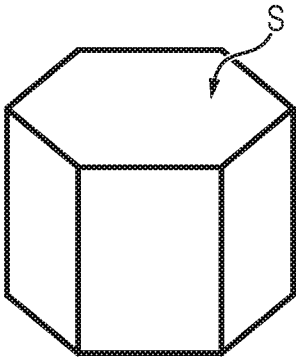
Figure 2F:
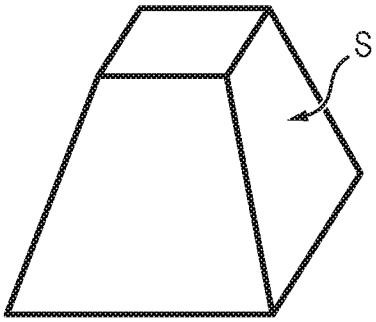
Figure 2G:
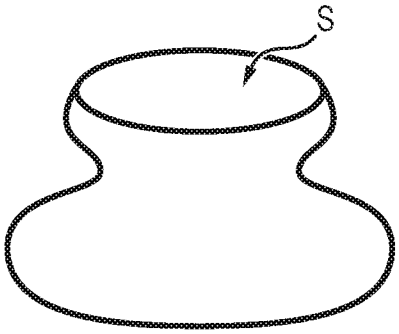

The carrier substrate S may be a number of shapes: a cylinder of revolution (FIG. 2*a*), a truncated cone (FIG. 2*b*), a spherical cap (FIG. 2*c*), a cube (FIG. 2*d*), a right prism having a hexagonal base (FIG. 2*e*), a truncated pyramid (FIG. 2*f*), or any sort of volume with a sinuous profile for example (FIG. 2*g*).

Figures 3A, 3B, 3C:
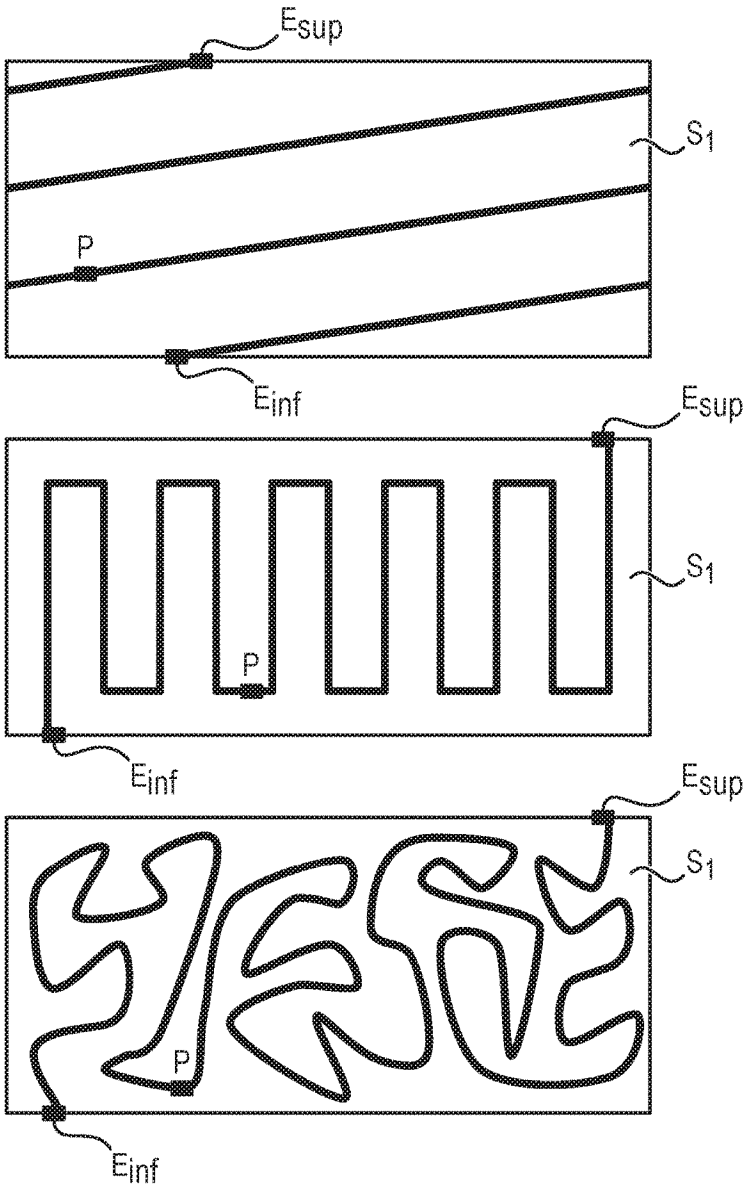
Figure 6:
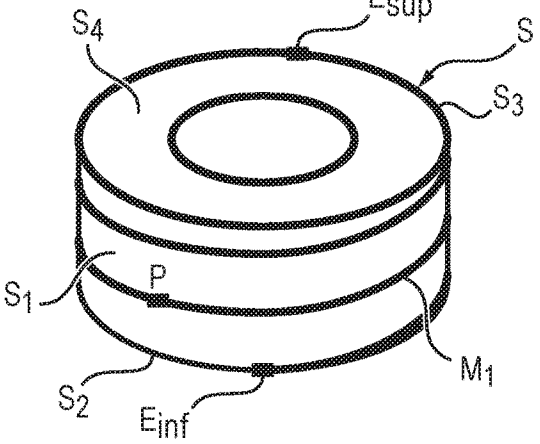
FIG. 6 illustrates a perspective view of a first conductive pattern inscribed on a carrier substrate of an antenna structure according to one embodiment of the invention.
Figure 7:
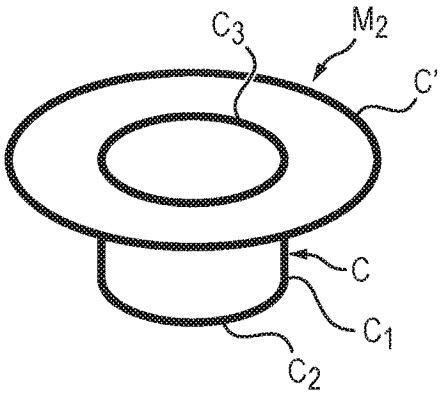
FIG. 7 illustrates a perspective view of a second conductive pattern of an antenna structure according to one embodiment of the invention.

The first pattern M1 may be a number of shapes. FIGS. 3*a*, 3*b* and 3*c* illustrate developed views of the peripheral lateral wall S1 of the carrier substrate S with a plurality of shapes of the first pattern M1: multi-turn helix (FIG. 3*a*), multi-meander geometry (FIG. 3*b*) or indeed an arbitrary shape (FIG. 3*c*). It may also be a combination of rectilinear and sinuous shapes or indeed a shape made up of one or more fractal patterns (not shown), or a sinusoidal shape (not shown).

The first conductive pattern M1 may either be a conductive wire or indeed a conductive strip.

In the case of a conductive wire, the diameter of the conductive wire is comprised between 0.25 mm and 5 mm and is preferably 1 mm.

In the case of a conductive strip, the width of the strip is comprised between 0.5 mm and 10 mm and is preferably 2 mm.

Furthermore, the developed length of the conductive wire or conductive strip is one of the elements that may be used to adjust operating frequency. The larger this length, the lower the frequency of the corresponding antenna.

The second pattern M2 may also be a number of shapes. FIGS. 4*a*, 4*b*, 4*c*, 4*d*, 4*e*, 4*f*, 4*g* and 4*h* illustrate shapes of the transverse profile of the second pattern M2: straight (FIG. 4*a*), top-hat (FIG. 4*b*), a succession of straight lines (FIGS. 4*c* and 4*e*), a succession of straight and curved lines (FIGS. 4*d* and 4*f*), and a succession of curved lines (FIGS. 4*g* and 4*h*).

As illustrated in FIGS. 4*b*, 4*c*, 4*d*, 4*e*, 4*f*, 4*g* and 4*h*, the second pattern M2 may have a portion that extends, through the interior of the internal volume S4 of the carrier substrate S, toward the proximal end S2 of the carrier substrate S.

Furthermore, the second pattern M2 may have an unapertured aspect ratio as is the case in FIGS. 4*a*, 4*b*, 4*c*, 4*d*, 4*e*, 4*f*, 4*g* and 4*h*, or indeed be apertured in its center (a ring for example).

Therefore, the volume of the carrier substrate S is used to carry and contain an overall conductive pattern that is electrically as long as possible, in order for the antenna to be able to operate at the lowest possible frequency.

In relation to FIGS. 5*a*, 5*b* and 5*c* and FIGS. 6 and 7, an antenna according to one preferred embodiment of the invention will now be described.

According to this preferred embodiment, the carrier substrate S is cylindrical in shape and the first conductive pattern M1 is a helix.

Furthermore, the carrier substrate S is a cylinder of revolution the transverse cross section of which is equal to a disk of diameter $d \ll \lambda$, and the height of which is equal to $h \ll \lambda$ (where $\lambda$ is the wavelength associated with the operating frequency of the corresponding antenna).

The first pattern M1 includes a plurality of turns wound on the peripheral lateral wall S1 of the carrier substrate S.

The second pattern M2 is here a patch inscribed in its entirety in the interior of the volume S4 defined by the carrier substrate S.

The second conductive pattern M2 consists of three portions:

- a hollow section C having a peripheral lateral wall C1 that extends between a lower end C2 and an upper end C3,
- a flange C' that extends from the upper end C3 of the section to the distal end S3 of the carrier substrate S, and
- a bottom C" that completely obturates the lower end of the section C.

The bottom C" is characterized by a surface the external perimeter of which corresponds to the lower end C2 of the section C.

The flange C' here takes the form of an annular conductive pattern of outside diameter d and inside diameter d' (where $0<d'<d$), completed by a tubular conductive section C of diameter d' and height h' (where $0<h'<h$), obturated at its base by the bottom C" in the form of a conductive disk of diameter d'. It will be noted that, in this precise case, the second conductive pattern M2 obturates the entire upper portion of the carrier substrate S.

Furthermore, the section C extends into the internal volume S4 defined by the carrier substrate, and the bottom C" is contained in the interior of the same volume.

Thus, the second pattern M2 is like an upside-down hat above the carrier substrate S with a portion (i.e. the section C and the bottom C") inserted into the interior of the internal volume of the carrier substrate S. The upside-down hat thus forms the three-dimensional carrier.

Because of its structure, the antenna is said to be what is called a "bung" antenna.

The first and second conductive patterns M1, M2 are electrically connected: the second pattern M2 is especially electrically connected to the upper end Esup of the first conductive pattern M1.

A prototype of an antenna according to this preferred embodiment was developed and tested.

This prototype had the following characteristics: excluding the ground plane M, a radiating element formed by associating the first conductive pattern M1 and the second conductive pattern M2 was contained in a cylindrical volume, of diameter equal to 30 mm and a height equal to 20 mm.

Given the measured operating frequency, of a value of 193 MHz (corresponding to a wavelength $\lambda$ of 1554 mm), the largest dimension of the antenna (i.e. the diameter of the carrier substrate S of 30 mm) was then about $\lambda/52$, thereby implying an extremely compact antenna. Furthermore, at this frequency of 193 MHz, the antenna was perfectly matched (i.e. a mismatch loss<−25 dB) and the width of its passband (for a mismatch loss lower than −10 dB) was 1.3 MHz.

Thus, such an antenna would be usable for applications developed at the VHF and UHF frequencies.

Antenna Array

Figure 8:
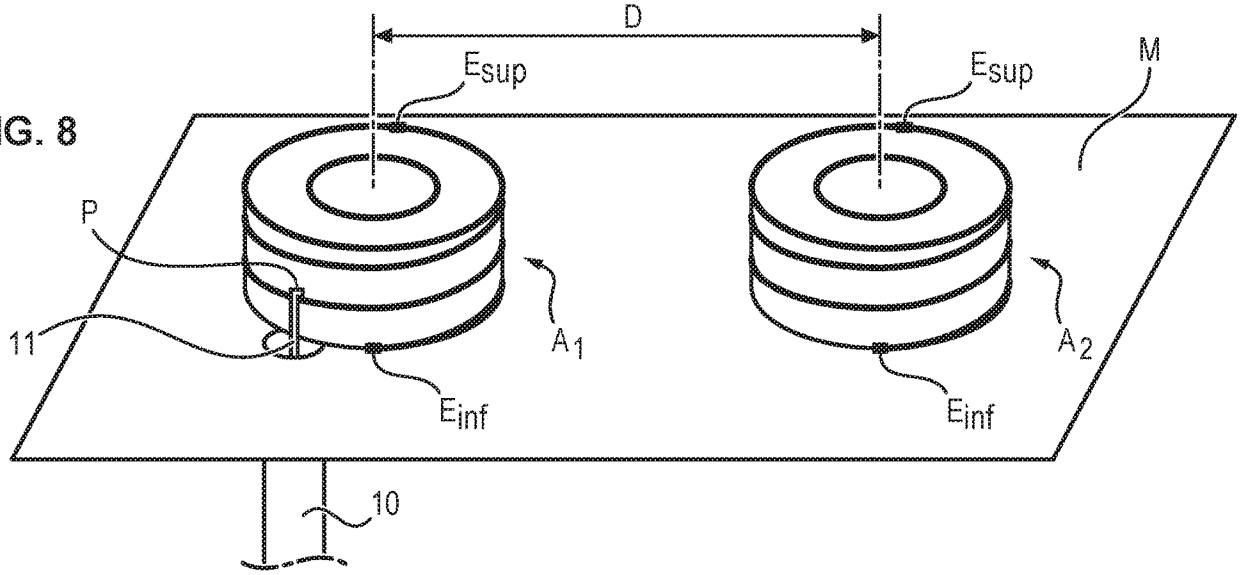
FIG. 8 illustrates an antenna array according to a first embodiment of the invention.
Figure 9:
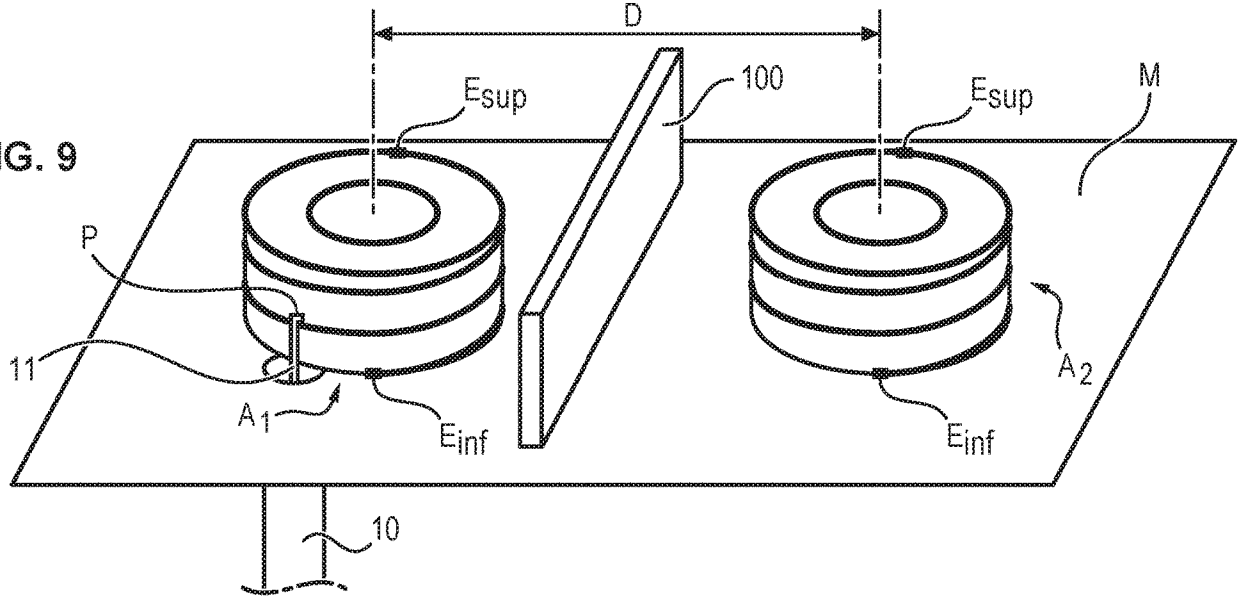
FIG. 9 illustrates an antenna array according to a second embodiment of the invention.
Figure 10:
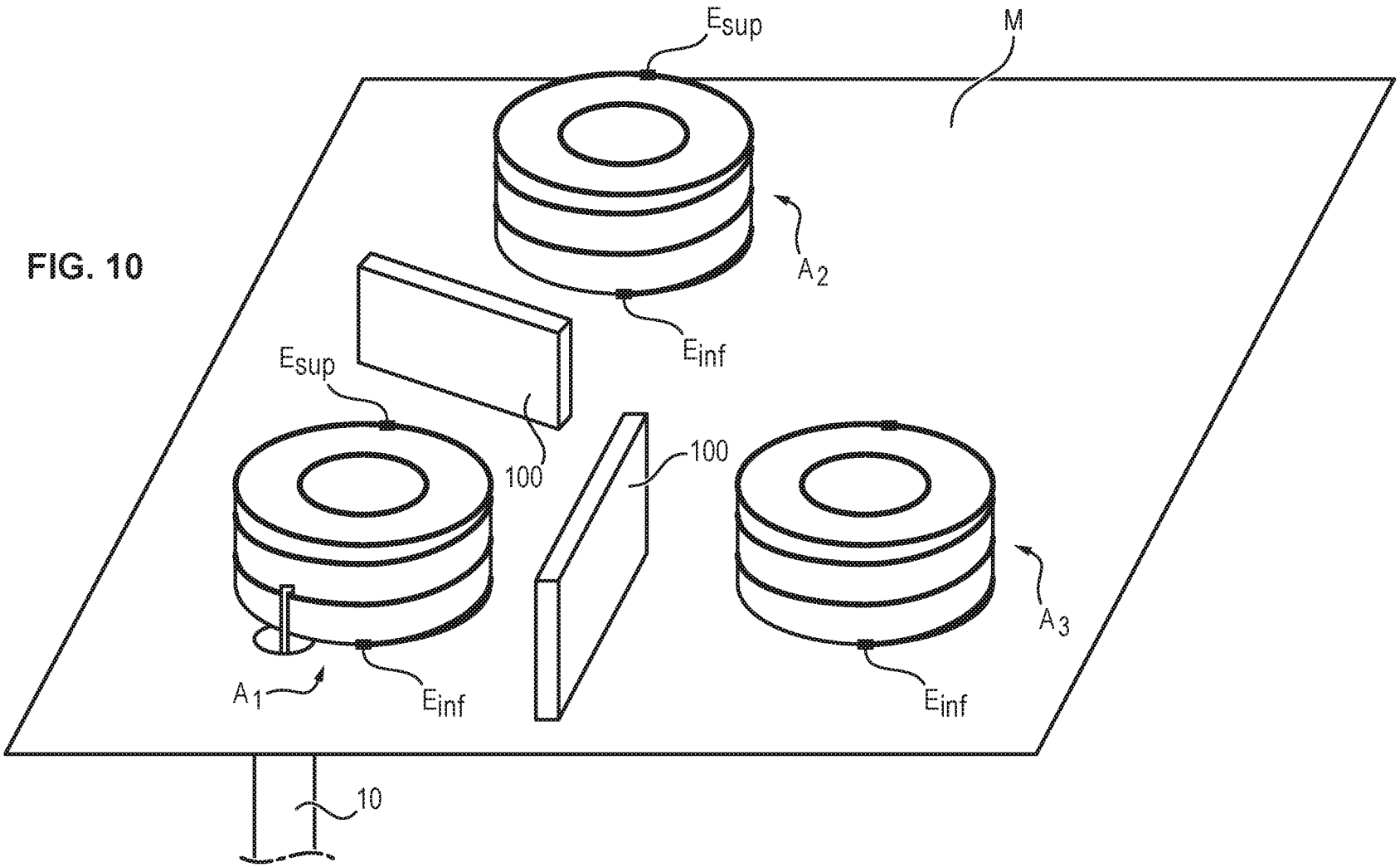
FIG. 10 illustrates an antenna array according to a third embodiment of the invention.

In relation to FIGS. 8, 9 and 10, the invention also relates to an antenna array comprising a ground plane M; a plurality of identical antenna structures Ai ($i \geq 2$) such as described above; and an excitation probe 10 connected to a point P of the first conductive pattern M1 of only one antenna structure from the plurality of antenna structures A1, A2, so as to supply just one antenna structure directly.

The antenna structure thus excited defines a primary element of the antenna array, the at least one other antenna structure defining at least one "passive" secondary element that is not supplied directly.

Thus, the antenna array comprises an antenna and at least one antenna structure (which acts as a parasitic element) located near the antenna.

Relative to the antenna, the antenna array has a wider passband.

FIG. 8 illustrates an antenna array comprising two antenna structures A1, A2 placed one beside the other.

In this embodiment, the configuration consists in associating first and second antenna structures A1, A2 that are positioned, one relative to the other, at a distance D that is very small relative to the wavelength of the signal $\lambda$, this being done in order to preserve a particularly small overall size for the antenna array.

In this embodiment, for an operating frequency of 193 MHz, corresponding to a wavelength $\lambda$ of 1554 mm, the distance D between the two structures (i.e. the distance between the central axes of symmetry of the structures A1, A2) is 70 mm, i.e. about $\lambda/22$ (and thus $D \ll \lambda$). It will be noted that this very great proximity between the structures is made possible by the miniature character of the antenna structures used (the antenna structures are about $\lambda/52$ in size).

Again in relation to the embodiment in FIG. 8, the first antenna structure A1, which is supplied directly by the coaxial excitation probe 10, plays the role of a primary radiating element supplied at a connection point P by the central conductor 11 of the excitation probe 10. The directly supplied first antenna structure A1 is electromagnetically coupled to the second antenna structure, of identical configuration, but that is, for its part, not supplied directly.

This second antenna structure therefore plays the role of a "passive" secondary element that initially operates at the same resonant frequency as the first antenna structure A1 and that is positioned in the immediate environment thereof, in order to be physically coupled thereto.

Due to the combination of the two antenna structures A1, A2, the electrical response of the first antenna structure A1 is then a bi-frequency response, with frequency values that are relatively close to each other.

The separation of the frequencies depends on the value of the level of coupling between the first antenna structure A1 and the second antenna structure A2. The lower this level, the closer the frequencies. With a first antenna structure A1 coupled to a second antenna structure A2, we therefore obtain, all things considered, a response equivalent to that of a two-pole passband filter is therefore obtained, and thereby a significant widening of the passband relative to that which would be obtained if only the first antenna structure were used.

In order to maintain a good mismatch loss right across the passband of the first antenna structure A1 coupled to the second antenna structure A2, the two resonant frequencies participating in the electrical response must be very close to each other, thereby requiring, a priori, a very low level of coupling between the antenna structures A1, A2.

This condition may be met very simply by increasing the distance D between the two antenna structures, but to the detriment of the compactness of the antenna array.

In order to enable the compact character of the antenna array to be preserved, by choosing a D of very small value relative to the wavelength λ, the decrease in the coupling may simply be obtained by virtue of the presence of an electrical screen between the two antenna structures A1, A2, this screen possibly being produced, for example, using a conductive wall 100 connected electrically at its base to the ground plane, as is illustrated in FIG. 9. In this case, the position of the conductive wall 100 and its geometry and size allow the value of the coupling to be adjusted and therefore the shape of the electrical response in the passband to be finely controlled.

It is possible to add antenna structures to increase the width of the passband.

As was specified above in the case of two elements, the basic principle then consists in constructing a multi-pole passband-filter-type electrical response for the primary element by exploiting the coupling of this primary element A1 to all the other "passive" secondary elements Ai (i>1). In this structure, the number n of antenna structures, their geometric arrangement on the ground plane, and the number, positions and characteristics of the conductive walls are parameters of freedom as regards the design and optimization of such an antenna array.

By way of example, FIG. 10 illustrates an antenna array comprising three antenna structures A1, A2, A3 placed triangularly on the ground plane M and comprising two conductive walls.

A prototype of an antenna array as illustrated in FIG. 9 was developed and tested.

Figure 5A:
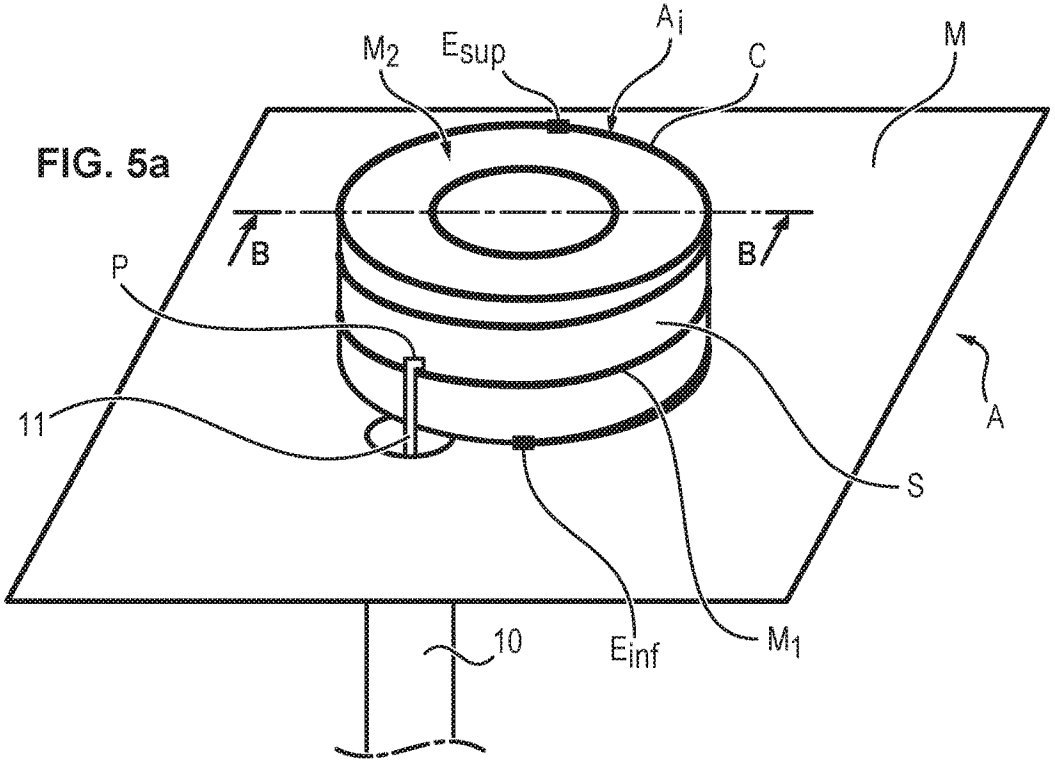
Figure 5C:
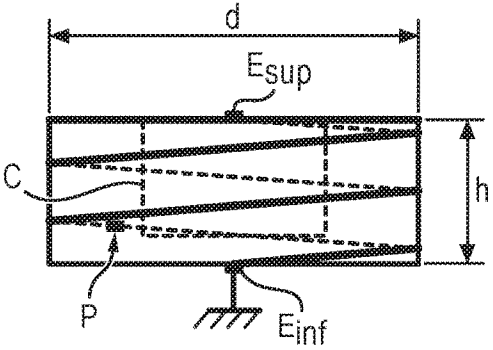
Figure 5B:
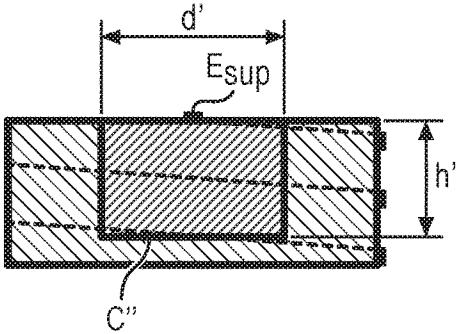

This prototype corresponded to the association of two antenna structures such as the antenna of the embodiment illustrated in FIG. 5*a*.

An increase in the passband of more than 50% was observed relative to the antenna according to the embodiment illustrated in FIG. 5*a*.

The size of each antenna structure of this prototype was λ/52. The antenna array operated at a frequency of 193 MHz. The two antenna structures were separated by a distance D of 70 mm, i.e. λ/22, and the electrical screen allowing the level of coupling between the two elements to be controlled was a single rectangular conductive wall (dimensions of 30×70 $mm^2$) positioned between the two antenna structures.

The invention claimed is:

1. An antenna structure suitable for being placed on a ground plane, comprising:

a three-dimensional carrier substrate made of a partially apertured dielectric material comprising a peripheral wall that extends between a proximal end and a distal end, the carrier substrate defining an internal volume; and a radiating element comprising a first radiating conductive pattern inscribed on the peripheral wall of the carrier substrate, the first radiating conductive pattern having a lower end electrically and mechanically connected to the ground plane and an upper end, and a second radiating conductive pattern contained in the internal volume defined by the carrier substrate, wherein the second radiating conductive pattern is electrically connected to the upper end of the first radiating conductive pattern, wherein the antenna structure is placed above the ground plane, and the lower end of the first radiating conductive pattern being connected to the ground plane, the antenna structure further comprising an excitation probe supplying the first radiating conductive pattern, the excitation probe being connected, by way of a central conductor of the excitation probe, to the first radiating conductive pattern via a connection point intermediate to said lower end and said upper end on the peripheral wall, and wherein the second radiating conductive pattern comprises:

a hollow section having a peripheral wall that extends between a lower end and an upper end, said section extending into the internal volume defined by the carrier substrate; and a flange that extends from the upper end of the section to the distal end of the carrier substrate.

2. The antenna structure as claimed in claim 1 wherein the carrier substrate is the shape of a cylinder of revolution, a truncated cone, a cube, a right prism having a hexagonal base, a truncated pyramid or a volume with a sinuous profile.

3. The antenna structure as claimed in claim 1 wherein the first radiating conductive pattern is a conductive wire or a conductive strip.

4. The antenna structure as claimed in claim 1 wherein the first radiating conductive pattern is inscribed on the peripheral wall so as to be wound into a helix around the carrier substrate.

5. The antenna structure as claimed in claim 1 wherein the first radiating conductive pattern has a meandering shape, a sinusoidal shape, a shape formed from a combination of rectilinear and sinuous shapes or a shape made up of one or more fractal patterns.

6. The antenna structure as claimed in claim 1 wherein the second radiating conductive pattern is configured to at least partially obturate the distal end of the internal volume defined by the carrier substrate.

7. The antenna structure as claimed in claim 1 wherein the second radiating conductive pattern has a transverse profile chosen from the following group: straight, top-hat, a succession of straight lines, a succession of straight and curved lines, and a succession of curved lines.

8. The antenna structure as claimed in claim 1 wherein the second radiating conductive pattern also has a bottom completely closing the lower end of the section.

9. An antenna array comprising:

a ground plane;

a plurality of identical antenna structures as claimed in claim 1; and an excitation probe connected, by way of the central conductor of said excitation probe, to the first radiating conductive pattern of only one antenna structure from the plurality of antenna structures, said antenna structure thus excited defining a primary element of the antenna array, the at least one other antenna structure defining at least one passive secondary element that is not supplied directly.

10. The antenna array as claimed in claim 9, comprising two antenna structures placed on the ground plane side-by-side and separated by a distance smaller than a fraction of the operating wavelength λ of the antenna array, typically smaller than λ/20.

11. The antenna array as claimed in claim 9, comprising three antenna structures placed triangularly on the ground plane.

12. The antenna array as claimed in claim 11, comprising at least one conductive wall suitable for decreasing the coupling between the antenna structures, the conductive wall forming an electrical screen between the antenna structures.

* * * * *